US012434930B2

(12) United States Patent
Balabanov et al.

(10) Patent No.: US 12,434,930 B2
(45) Date of Patent: Oct. 7, 2025

(54) AEROGRIPPER APPARATUS, SYSTEM, AND METHODS

(71) Applicant: The North Face Apparel Corp., Wilmington, DE (US)

(72) Inventors: Demitri Balabanov, Greensboro, NC (US); Dewayne Steward, Madison, NC (US)

(73) Assignee: The North Face Apparel Corp., Wilmington, DE (US)

( * ) Notice: Subject to any disclaimer, the term of this patent is extended or adjusted under 35 U.S.C. 154(b) by 236 days.

(21) Appl. No.: 17/624,284

(22) PCT Filed: Jun. 30, 2020

(86) PCT No.: PCT/US2020/040269
§ 371 (c)(1),
(2) Date: Dec. 31, 2021

(87) PCT Pub. No.: WO2021/003141
PCT Pub. Date: Jan. 7, 2021

(65) Prior Publication Data

US 2022/0356023 A1 Nov. 10, 2022

Related U.S. Application Data

(60) Provisional application No. 62/869,783, filed on Jul. 2, 2019.

(51) Int. Cl.
*B65H 3/14* (2006.01)
*B65H 5/10* (2006.01)

(52) U.S. Cl.
CPC ..... *B65H 5/10* (2013.01); *B65H 3/14* (2013.01); *B65H 2405/581* (2013.01);
(Continued)

(58) Field of Classification Search
CPC ... B65H 5/10; B65H 5/14; B65H 3/14; B65H 3/32; B65H 2405/5812; B65H 3/54
See application file for complete search history.

(56) References Cited

U.S. PATENT DOCUMENTS 3,877,695 A 4/1975 Carroll
4,462,585 A 7/1984 Gieson et al.
(Continued)

FOREIGN PATENT DOCUMENTS

CN 206606793 U 11/2017
DE 4229955 A1 3/1994
(Continued)

OTHER PUBLICATIONS

Translation of DE 42 29 955 provided by Google Patents (Year: 2023).*
(Continued)

*Primary Examiner* — Patrick Cicchino
(74) *Attorney, Agent, or Firm* — Smith, Gambrell & Russell LLP

(57) ABSTRACT

An apparatus may comprise a curved surface; a fluid outlet disposed to cause a fluid to move adjacent the curved surface; a sensor configured to detect a material disposed adjacent the curved surface; and a clamp configured to actuate based on detection, via the sensor, of a material disposed adjacent the curved surface, wherein the clamp is further configured to secure the material to the curved surface upon activation.

19 Claims, 4 Drawing Sheets

(52) U.S. Cl.
CPC ..... *B65H 2405/5812* (2013.01); *B65H 2405/584* (2013.01); *B65H 2406/122* (2013.01); *B65H 2406/366* (2013.01); *B65H 2511/51* (2013.01); *B65H 2701/174* (2013.01)

(56) References Cited

U.S. PATENT DOCUMENTS

| | | | | |
|---|---|---|---|---|
| 4,708,333 | A * | 11/1987 | Servi | B65H 3/22 271/106 |
| 6,125,754 | A * | 10/2000 | Harris | B65H 23/34 226/7 |
| 9,120,634 | B1 * | 9/2015 | Muir | B65H 5/22 |
| 10,906,755 | B1 * | 2/2021 | Appel | B65H 3/14 |
| 11,161,705 | B2 * | 11/2021 | Steward | B65H 5/14 |
| 2004/0217540 | A1 * | 11/2004 | Sinai | B65H 3/14 271/98 |
| 2021/0002093 | A1 | 1/2021 | Steward | |

FOREIGN PATENT DOCUMENTS

| | | | |
|---|---|---|---|
| JP | 7332727 | B2 | 8/2023 |
| WO | 2021/003061 | A1 | 1/2021 |

OTHER PUBLICATIONS

Office Action received for Canadian Patent Application No. 3146121, mailed on Mar. 26, 2024, 6 pages.

Office Action received for Chinese Patent Application No. 202080054747.9, mailed on Jun. 28, 2024, 21 pages (13 pages of English Translation and 8 pages of Original Document).

Office Action received for European Application No. 20743489 , mailed on Jul. 5, 2024, 5 pages.

* cited by examiner

AEROGRIPPER APPARATUS, SYSTEM, AND METHODS

TECHNICAL FIELD

The present relates generally to material handling apparatus, systems, and methods, and more particularly to aerogripper apparatus, systems, and methods for separating and moving an uppermost ply from a stack of fabric plies.

BACKGROUND

In the manufacture of clothing, it is conventional to lay out fabric in a plurality of layers or plies during various processes. For example, fabric may be disposed in a stack of layers or plies on a cutting table and then cut to a desired pattern through the entire thickness of cloth layers to form a stack of apparel pieces. Individual pieces of fabric must then be separated from the stack and joined to other components of a garment in a sewing operation or assembly process. Such fabric parts may include such items as pockets, sleeves, or other garment components as are required. It is challenging to mechanically separate a single fabric ply from a stack of identical fabric pieces. For instance, difficulties may arise because the fabric is not sufficiently stiff, but relatively supple and flexible. Additionally, friction between the layers and the edges can cause the plies to stick together. Therefore, techniques that operate satisfactorily in connection with sheets of wood, paper, or other articles that are relatively stiff are not generally successfully utilized in connection with fabric plies. Some attempts to mechanize the separation of one fabric ply from a stack of similarly shaped fabric plies include pins, pincers, suction devices, rollers, hooks, barbs, air blasts, frictional buckling devices, and the like.

As an example, one type of fabric ply separating device which utilizes an air blast is illustrated and described in the patent to Carroll U.S. Pat. No. 3,877,695. Other devices, such as those illustrated in the U.S. patent to Gieson et al U.S. Pat. No. 4,462,585, utilize a mechanical gripping device which indirectly and mechanically senses the distance between the jaws thereof to determine whether one or more sheets have been clamped.

However, improvements are needed.

SUMMARY

An apparatus may comprise a curved surface; a fluid outlet disposed to cause a fluid to move adjacent the curved surface; a sensor configured to detect a material disposed adjacent the curved surface; and a clamp configured to actuate based on detection, via the sensor, of a material disposed adjacent the curved surface, wherein the clamp is further configured to secure the material to the curved surface upon activation.

A method for destacking at least one ply from a stack of material plies may comprise securing a stack of material plies; generating, an aerodynamic lift adjacent an uppermost ply of the stack of material plies; and activating, based on sensing the uppermost ply, a clamp to secure the uppermost ply of material to a curved surface.

A system for destacking at least one ply from a stack of material plies comprises a main body; a curved body mounted to the main body, the curved body further comprising a curved surface; a fluid inlet disposed on a first side of the main body to receive a fluid; a plurality of fluid outlets connected, via one or more channels, to the fluid inlet, configured to cause a fluid to move adjacent the curved surface; a sensor configured to detect a material disposed adjacent the curved surface; and a clamp configured to actuate based on detection, via the sensor, of a material disposed adjacent the curved surface, wherein the clamp is further configured to secure the material to the curved surface upon activation.

BRIEF DESCRIPTION OF THE DRAWINGS

The following drawings show generally, by way of example, but not by way of limitation, various examples discussed in the present disclosure. In the drawings.

DETAILED DESCRIPTION

Described herein are apparatus, systems, and methods for material handling. As an example, an aerogripper apparatus may be configured to destack one or more plies from a plurality (e.g., stack) of flexible or semi-rigid fabric plies or layers while maintaining the integrity of the remainder of the stack. The systems and/or methods may capture information from one or more steps of a management or manufacturing process to effect the steps described herein. Reference may be made herein to fabric or textiles as an illustration. However, application to a broader range of materials is contemplated and thus should not be limited to such illustrative terms.

As a further example, a method for destacking one or more plies from a plurality of plies or layers may comprise mechanically securing a stack of fabric plies through contact. Once secured, an aerodynamic lift (e.g., via an aerogripper apparatus) is generated by causing air to flow around a curved (e.g., cylindrical) body that is disposed adjacent an upper most ply of the stack of fabric. If the edge of the fabric is not lifted after certain time, an agitator may be used to disturb the stack of fabric. If the edge is still not lifted, the aerogripper may be rapidly lifted up to create additional low pressure forces to disturb at least the uppermost ply or layer of fabric. When a sensor detects a lifted edge of the ply, a clamp may be activated to secure one or more plies of fabric to the aerogripper apparatus. The air flow may be stopped. The aerogripper apparatus, together with the secured edge of the fabric, may be pulled back from the lifted edge to the opposite edge, resulting in a removal of at least a single ply from the stack.

Figure 1:
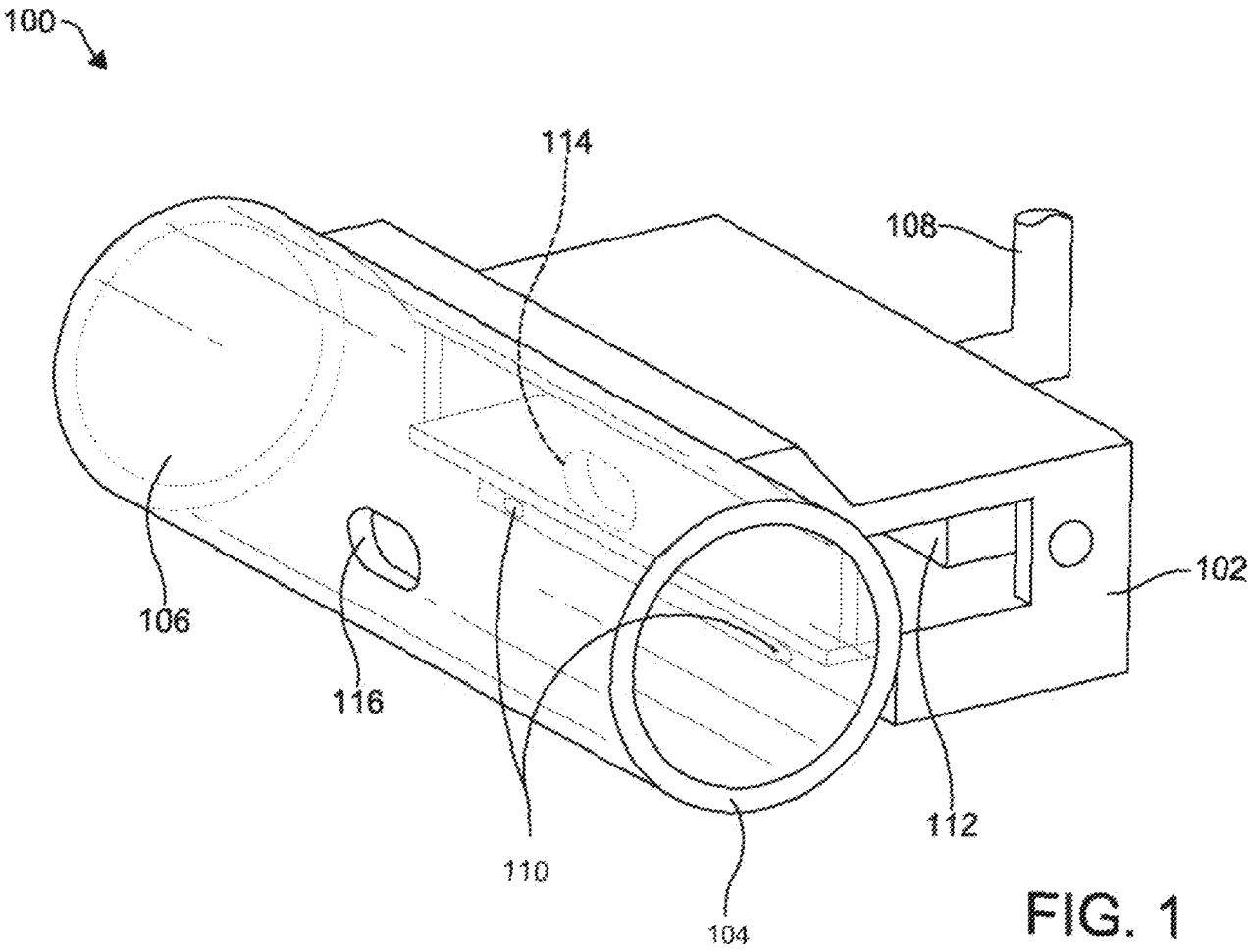
FIG. 1 shows an example apparatus.

FIG. 1 illustrates an example apparatus 100 (e.g., aerogripper apparatus). The apparatus 100 may comprise a main body 102. Main body may be configured to be moveable attached to frame, such as a fabric or material handling frame configured to receive material plies or cut material components.

A curved body 104 may be coupled to or formed with the main body 102. In some embodiments, the curved body 104 may comprise a generally cylindrical shape. The curved body 104 may comprise a curved surface 106. Various curves may be used (e.g., logarithmic curves, parabolic, etc.). The curved surface 106 may be smooth (e.g., no or minimal bumps, ridges, etc.) in order to minimize turbulence.

A fluid inlet 108 may be coupled to or integrated with the main body 102. The fluid inlet 108 may be configured to allow fluid such as air to flow toward the curved surface 106. As an example, the fluid inlet 108 may comprise a conduit configured to pass a fluid through a portion of the main body 102 and toward the curved surface 106. One or more fluid outlets 110 may be disposed adjacent or through a portion of the main body 102. The one or more fluid outlets 110 may comprise an aperture. In some embodiments, the one or more fluid outlets may be apertures (e.g., cylindrical openings) drilled or punched into a plate mounted onto or integrated with the main body 102, or otherwise distally coupled with the curved body 104. Such cylindrical fluid outlets are configured to create a "spread-out" cone effect of the directed fluid (rather than a concentrated cone), thereby causing more air to engage with a surface (e.g., effectively creating one long cylindrical outlet along the entire extent of the curved body or surface). Alternatively, fluid outlets may be configured as an array of small circular outlets (ex. adding additional outlets in between the current two, effectively creating a line of air outlets). The outlets can be external to the curved surface (as in the embodiment shown in FIG. 1) or be integrated with the curved surface, ejecting air tangent to the curved surface. The number, density, and geometric parameters of the fluid outlets 110 may depend on the desired strength of the air dynamic effect, where the detachment point will be, the fluid pressure at the fluid inlet 108, air flowrate, etc.

The one or more fluid outlets 110 may be configured to direct fluid flow substantially perpendicularly (or tangentially) to the curved surface 106 at the point or line where the fluid exits the fluid outlets 110, thereby initiating fluid flow around the curved surface to create the lift needed to initiate separation of the uppermost ply or plies of material from the remainder of the stack. As air is blown past the smooth, curved surface 106, a "boundary" layer of air may form immediately next to the curved surface 106 and cling to it, following the contours of that surface. Such a configuration enables lifting of a single ply from the material stack without disturbing the remainder of the stack. The boundary layer of air that forms includes some characteristics that enable the lifting of at least one material ply. As an example, air may move generally parallel to the surface of a material (e.g., fabric) disposed adjacent the curved surface 106, instead of through it (as would be the case for vacuum grippers). Air adjacent to the curved surface 106 may be slow-moving or even stationary. Moving radially away from the curved surface 106, the air speed increases dramatically, reaches a maximum some small distance away from the surface, and gradually decreases at some distance farther away from the curved surface 106. Effectively, the formed air layer may be a "sheet of fast-moving air" configured to wrap around the curved surface 106. In the case of a cylinder, a "detachment" spot (e.g., line) on the front of the cylinder (e.g., about 120 degrees from where air impinges onto the cylinder). At the detachment spot, the sheet of air may detach from the cylinder and flow essentially tangent to the cylinder. Alternative design configurations, including those having a cylindrical shape, may cause the "sheet of air" to completely wrap around the surface. In the above described embodiments, the lift process is not dependent on the porosity of the material and may be utilized with porous and nonporous materials.

The one or more fluid outlets 110 may be in fluid communication with the fluid inlet 108. In one example embodiment, the interior of the main body 102 may include a plurality of channels (e.g., two or more) connecting fluid inlet 108 on, for instance a first side of the main body 102 (e.g., a side farthest away from the curved body 104) and one or more fluid outlets 110 on another side of the main body 102 (e.g., a side closest to the curved body 104). In some embodiments, a single fluid inlet channel may be split per number of outlets (in this case 2). The shape of the channels may be substantially identical such that the fluid that flows through each channel is split substantially evenly between the channels. If the channels comprise different shapes (e.g., diameters, etc.), then fluid may distribute unevenly, causing more fluid to exit some outlets than others. Fluid such as air may pass between the fluid inlet 108 and the fluid outlets 110 at a pressure of about at about 80-100 psi. Other pressures and fluids may be used. Fluid flow may be generated by a compressor or by means of an electric motor with a propeller or fan mechanism that is external or internal to the curved surface 106.

A sensor 112 may be disposed to sense one or more conditions adjacent the curved surface 106. As shown in FIG. 1, the sensor 112 may be disposed adjacent the main body 102 and may be mounted to the main body 102. As an example, an infrared (IR) type sensor (e.g., photo sensor) may be configured emit a beam of light and to sense an interruption on the beam (e.g., when an edge of a ply covers the beam's window). Other sensors can be readily used depending, in part, on the fabric/material. The sensor 112 may be configured to sense not just that the beam has been interrupted (thus the edge of a ply successfully lifted) but also whether there is one ply or more that have been lifted (e.g., an adjacent ply may be stuck to the top ply). The sensor 112 may be external to or integrated with the curved surface 106. One or more sensor apertures 114, 116 or windows may be formed in the main body 102 and/or the curved body 104 to allow the sensor 112 to better sense adjacent the curved surface 106.

Figure 2:
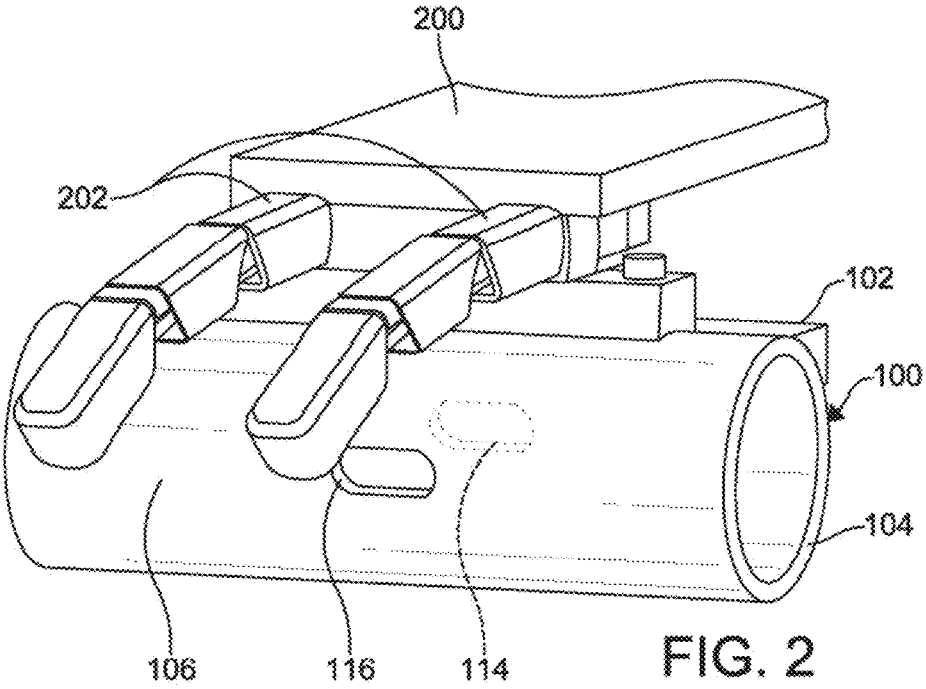
FIG. 2 shows an example system.
Figure 3:
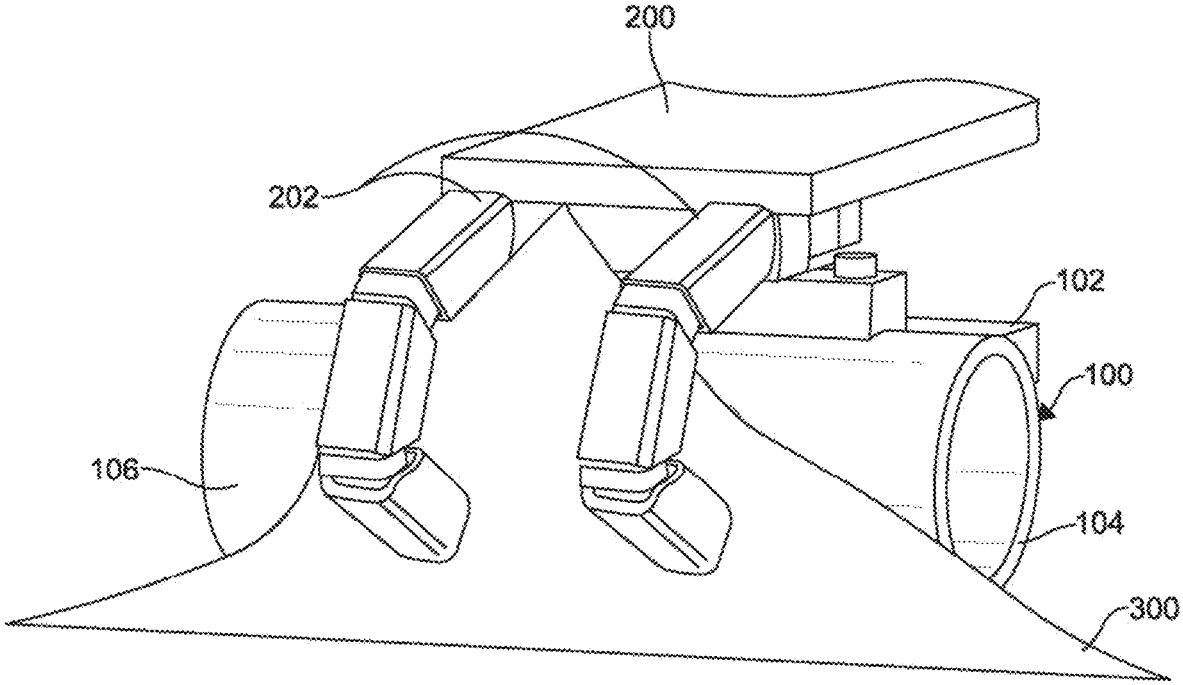
FIG. 3 shows the example system of FIG. 2 clamping a ply of fabric.

FIG. 2 illustrates the apparatus 100 coupled to a frame 200. One or more clamps 202 may be disposed on the frame 200 adjacent the apparatus 100 (e.g., mounted on a top portion of the apparatus 100). The clamps 202 may be configured to activate (e.g., actuate) to secure a lifted ply of material such as a fabric piece or ply against the curved body 104. The clamp may be an mechanical clamping mechanism (e.g., a two-fingered clamp or other such impactive clamp) configured to engage the lifted edge of the ply and, for example, hold it against a portion of the curved body 104. In other embodiments, clamp 202 may be non-restrictive/non-mechanical (e.g., glue-based, air/suction-based, magnetic, etc.). The frame 200 may be moveable and may be used to position the apparatus 100 adjacent a stack of fabric pieces or plies 300, as shown in FIG. 3. Once the sensor 112 senses that ply of material is adjacent the curved surface 106, the clamps 202 may be activated, as shown in FIG. 3. Airflow may be deactivated once the sensor 112 senses that the ply has been secured to the curved body 104 by the clamp(s) 202.

Figure 4A:
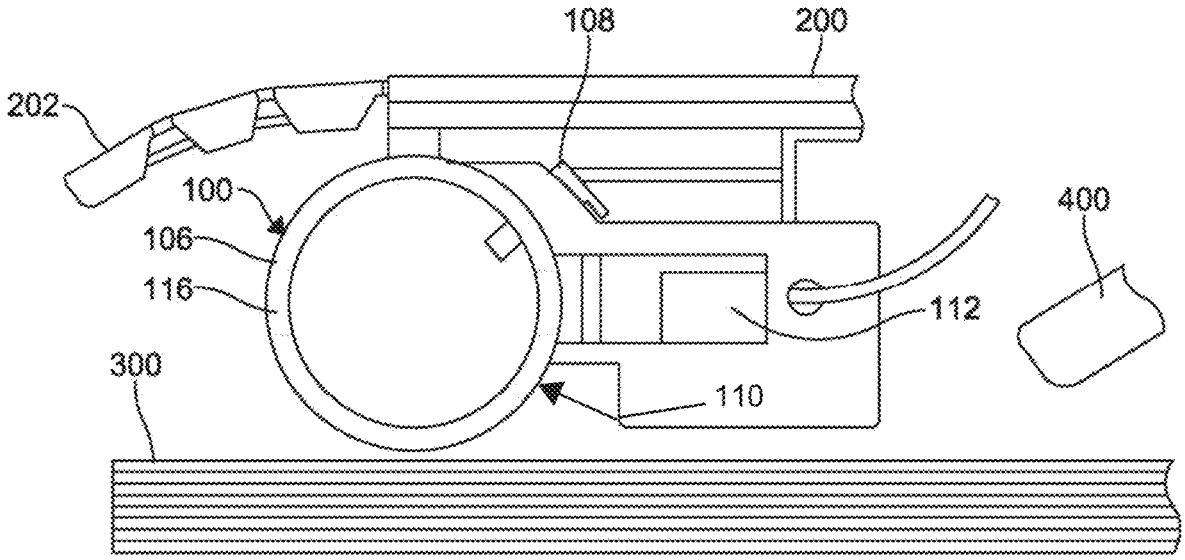
FIGS. 4A-4C shows an example process.
Figure 4B:
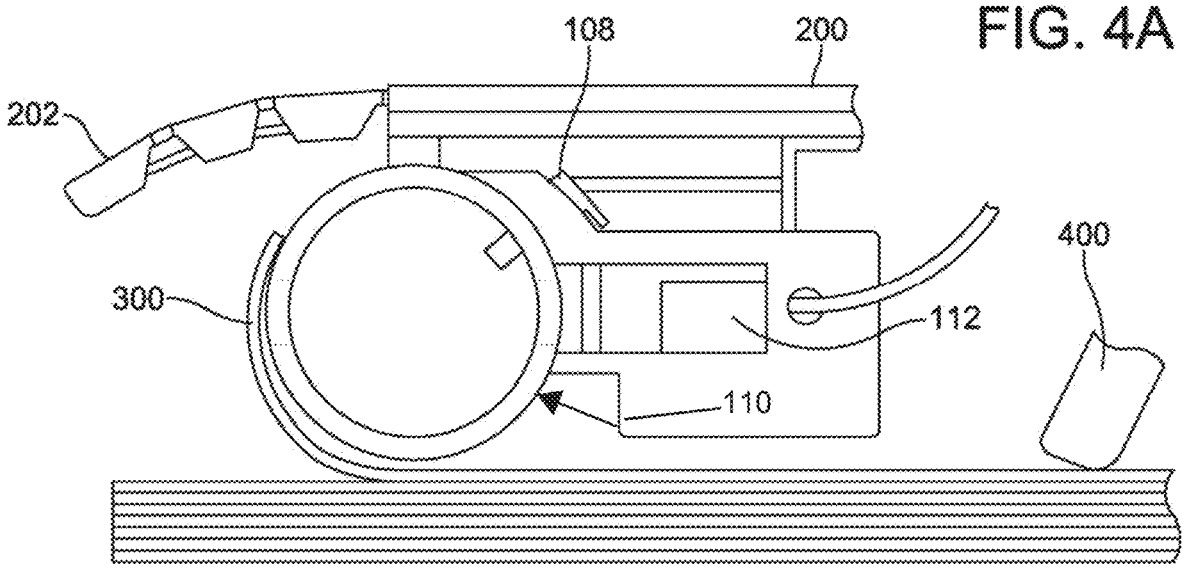
Figure 4C:
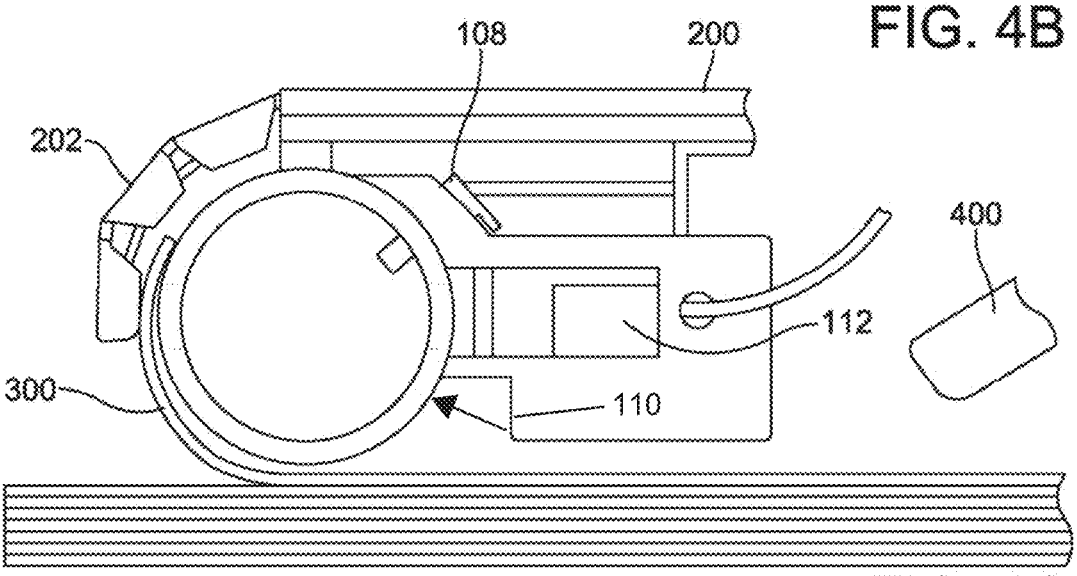

FIGS. 4A-4C illustrate a process for destacking one or more plies from a plurality of plies or layers may comprise mechanically securing a stack of fabric plies through contact. Once secured, an aerodynamic lift (e.g., via an aerogripper apparatus) is generated by causing air to flow around a curved (e.g., cylindrical) body that is disposed adjacent an upper most ply of the stack of fabric. If the edge of the fabric is not lifted after certain time, an agitator 400 may be used to disturb the stack of fabric. For instance, agitator 400 may be used to assist the aerodynamic lift in lifting the edge of a fabric. Agitator 400 may be used to lift the edge indirectly, by introducing irregularities (e.g., waves) to the ply. As an example, agitator 400 may slightly stretch or reversibly deform a ply or a portion of a ply, resulting in mechanical separation of the top ply from the one below while the introduced irregularity, (e.g., waviness) of the surface of a ply augments aerodynamic lift. In such a manner, agitator may act as a primer before the aerodynamic lift. That is, if the aerodynamic lift is unable secure the edge of a ply after a certain time duration (e.g., 2-3 seconds) then a signal may be sent to activate the agitator. The airflow may be engaged during this process. The agitator 400 may then introduce stretch, wave, or other such irregularity to a top ply to cause the edge of a ply to lift. In some embodiments, this process may execute without operator intervention.

As a non-limiting example, the agitator 400 may comprise a mechanical apparatus configure to generate turbulence among the stack of material plies. As a further example, the agitator 400 may comprise a mechanical apparatus similar to the clamps 202 (e.g., a two fingered clamp). Other configurations may be used. For example, agitator may comprise a wheel connected to an actuator (e.g., a motor). In another instance, the agitator 400 may comprise a portion of the curved surface (e.g., cylinder) which may be configured to rotate and thereby mechanically engage with the top ply. In still another embodiment, the aerogripper apparatus 100 is configured to be used as an agitator by pressing it against a stack of plies and slightly pulling the aerogripper apparatus 100 backwards.

If the edge is still not lifted, the aerogripper may be rapidly lifted up to create additional low pressure forces to disturb at least the uppermost ply or layer of fabric. When a sensor detects a lifted edge of the ply, a clamp may be activated to secure one or more plies of fabric to the aerogripper apparatus. The air flow may be stopped. The aerogripper apparatus 100, together with the secured edge of the fabric, may be pulled back from the lifted edge to the opposite edge resulting in a removal of at least a single ply from the stack.

Figure 5:
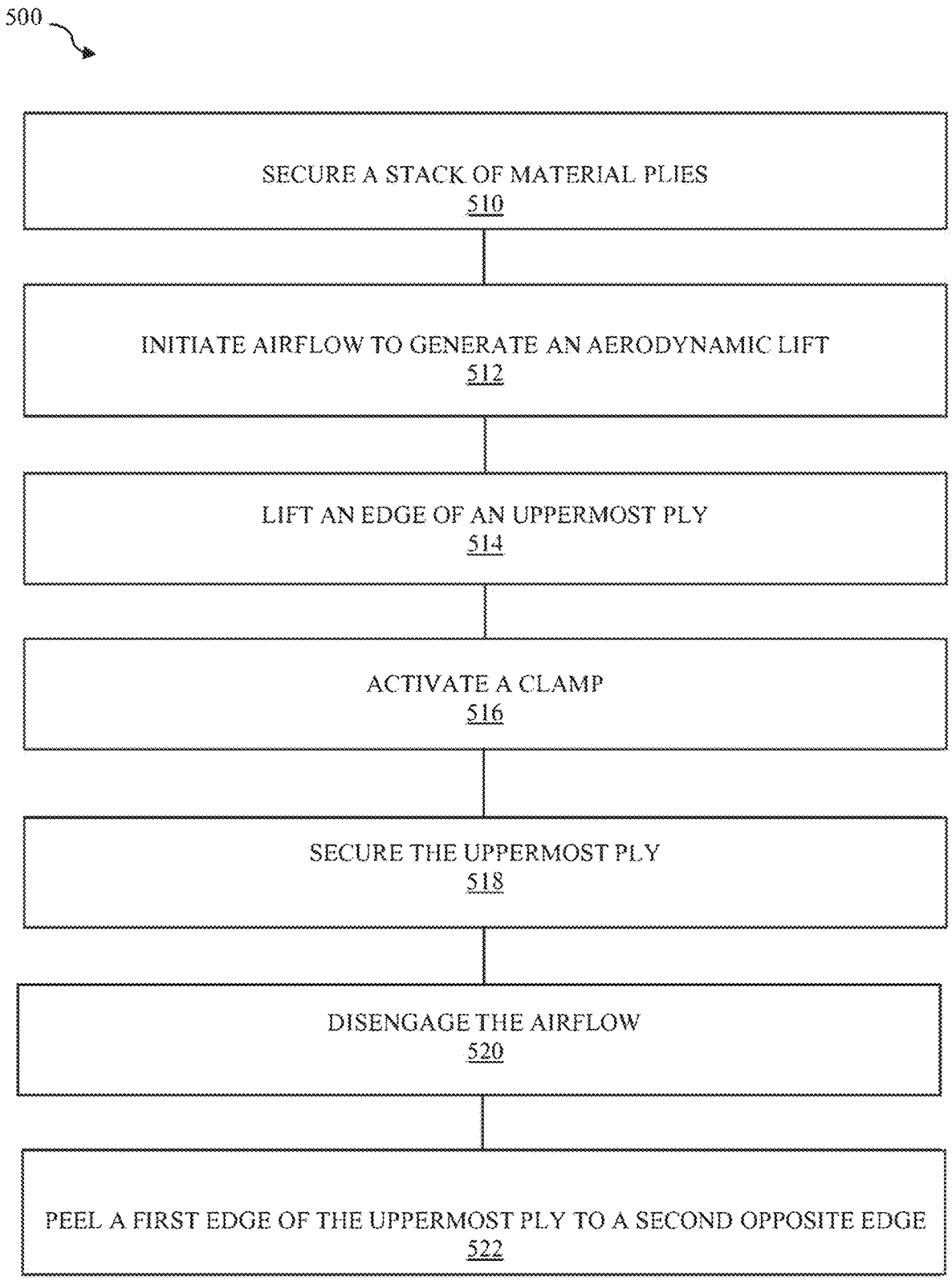
FIG. 5 is a flow diagram of an example method.

FIG. 5 is a flow diagram of an example method as illustrated in FIGS. 4A-4C. At step 510, a stack of plies (e.g., fabric plies) may be secured (e.g., through contact). At step 512, aerodynamic lift may be generated. Lift may be generated, for example, by initiating airflow via a source of air (e.g., fluid inlet 108). At step 514, aerogripper apparatus (e.g., apparatus 100), may lift an edge of a ply. If the ply is not engaged by the airflow, an agitator (e.g., agitator 400) may be activated to introduce an irregularity into an uppermost ply. If an edge of the ply has not been disengaged from the stack, the aerogripper apparatus may be rapidly lifted up and steps 512 and 514 may be repeated. At step 516, a clamp (e.g., clamp 202) may be activated when the lifting of an edge of a ply has been detected. At step 518, the clamp may secure the ply. At step 520, the airflow may be disengaged. At step 522, the edge of the ply may be peeled (e.g., pulled back) from the lifted edge to an opposite edge, resulting in removal of the uppermost ply in the stack.

It is to be understood that the apparatus, methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Ranges can be expressed herein as from one value (first value) to another value (second value). When such a range is expressed, the range includes in some aspects one or both of the first value and the second value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the designated value, approximately the designated value, or about the same as the designated value. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

Components are described that may be used to perform the described methods and systems. When combinations, subsets, interactions, groups, etc., of these components are described, it is understood that while specific references to each of the various individual and collective combinations and permutations of these may not be explicitly described, each is specifically contemplated and described herein, for all methods and systems. This applies to all aspects of this application including, but not limited to, operations in described methods. Thus, if there are a variety of additional operations that may be performed it is understood that each of these additional operations may be performed with any specific embodiment or combination of embodiments of the described methods.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations.

Unless otherwise expressly stated, it is in no way intended that any method set forth herein be construed as requiring that its operations be performed in a specific order. Accordingly, where a method claim does not actually recite an order to be followed by its operations or it is not otherwise specifically stated in the claims or descriptions that the operations are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

It will be apparent to those skilled in the art that various modifications and variations may be made without departing from the scope or spirit of the present disclosure. Other embodiments will be apparent to those skilled in the art from consideration of the specification and practices described herein. It is intended that the specification and example figures be considered as exemplary only, with a true scope and spirit being indicated by the following claims, along with the full scope of equivalents to which such claims are entitled.

What is claimed is:

1. An apparatus comprising:

a main body;

a curved surface;

a fluid inlet disposed on a first side of the main body configured to receive a fluid;

a fluid outlet disposed through a portion of the main body, wherein the fluid outlet is external to the curved surface and is configured to direct fluid flow substantially perpendicularly to the curved surface at a point or line where the fluid exits the fluid outlet;

a sensor configured to detect a material disposed adjacent the curved surface, thereby initiating fluid flow into the fluid inlet, wherein the fluid flow perpendicular to the curved surface initiates lift and separation of an uppermost ply from a stack of material plies such that the uppermost ply curves upwards toward the curved surface; and a clamp configured to actuate based on detection, via the sensor, of a material disposed adjacent the curved surface, wherein the clamp is further configured to secure the material against the curved surface upon activation.

2. The apparatus of claim 1, wherein the curved surface comprises at least a portion of a curved body.

3. The apparatus of claim 2, wherein the curved body has a generally cylindrical shape.

4. The apparatus of claim 1, wherein the fluid outlet is in communication with a source of pressurized fluid.

5. The apparatus of claim 1, wherein the fluid outlet is in communication with a source of pressurized air.

6. The apparatus of claim 1, further comprising an agitator configured to introduce an irregularity into the material.

7. The apparatus of claim 6, wherein the irregularity is a wave or a stretch.

8. The apparatus of claim 1, wherein the clamp is configured to peel a first edge of the material toward a second, opposite edge of the material.

9. The apparatus of claim 1, wherein the sensor is configured to detect when the material has been secured to the curved surface.

10. The apparatus of claim 9, wherein, upon detecting that the material has been secured to the curved surface, the sensor is configured to deactivate the fluid flow.

11. A method for destacking at least one ply from a stack of material plies, the method comprising:

securing a stack of material plies;

generating an aerodynamic lift adjacent an uppermost ply of the stack of material plies by causing a fluid to flow into a main body via a fluid inlet and be directed, via a fluid outlet, toward a curved body that is disposed adjacent an upper most ply of the stack of fabric and out of the main body, wherein the fluid outlet is external to the curved body and is configured to direct fluid flow substantially perpendicularly to the curved body at a point or line where the fluid exits the fluid outlet, thereby initiating fluid flow around the curved body, wherein the fluid flow around the curved body initiates lift and separation of the uppermost ply such that the uppermost ply curves upwards toward the curved body;

detecting, via sensor, whether a first edge of the ply has been disengaged from the stack of material plies; and activating, based on sensing a lifting of the uppermost ply, a clamp to secure the uppermost ply of material against a surface of the curved body.

12. The method of claim 11, wherein the aerodynamic lift is generated by initiating airflow via a source of air.

13. The method of claim 11, further comprising, upon detecting that the first edge has not been lifted, agitating, using the agitator, the uppermost ply of the stack of material plies.

14. The method of claim 13, wherein the agitating comprises introducing a wave or stretch to the uppermost ply.

15. The method of claim 12, further comprising, upon detecting, via the sensor, that the clamp has secured the uppermost ply of material, disengaging the airflow.

16. The method of claim 11, further comprising lifting, using the clamp, a first edge of the uppermost ply.

17. The method of claim 16, further comprising pulling, using the clamp, the lifted first edge of the uppermost ply toward a second edge of the uppermost ply.

18. A system for destacking at least one ply from a stack of material plies, the system comprising:

a main body;

a curved body mounted to the main body, the curved body further comprising a curved surface;

a fluid inlet disposed on a first side of the main body to receive a fluid;

a plurality of fluid outlets connected, via one or more channels, to the fluid inlet, wherein the fluid outlets are external to the curved surface and are configured to direct fluid flow substantially perpendicularly to the curved surface at a point or line where the fluid exits the fluid outlet, thereby initiating fluid flow around the curved surface of the curved body, wherein the fluid flow around the curved surface initiates lift and separation of the uppermost ply such that the uppermost ply curves upwards toward the curved surface;

a sensor configured to detect a material disposed adjacent the curved surface; and a clamp configured to actuate based on detection, via the sensor, of a material disposed adjacent the curved surface, wherein the clamp is further configured to secure the material to the curved surface upon activation.

19. The system of claim 18, further comprising an agitator configured to introduce an irregularity into the material.

* * * * *